United States Patent [19]

Lowdenslager

[11] 4,022,014

[45] May 10, 1977

[54] COMBINATION WRISTWATCH/CHRONOGRAPH/WRIST CALCULATOR/MEASURING DEVICE

[75] Inventor: John R. Lowdenslager, Stamford, Conn.

[73] Assignee: Timex Corporation, Waterbury, Conn.

[22] Filed: Apr. 4, 1975

[21] Appl. No.: 508,595

[52] U.S. Cl. ..... 58/23 R; 58/39.5; 58/152 R; 235/156

[51] Int. Cl.[2] ..... G04B 47/00; G04C 3/00

[58] Field of Search ..... 58/23 R, 23 A, 23 BA, 58/23 AC, 152 R, 152 H, 153, 50 R, 39.5; 235/156

[56] References Cited

UNITED STATES PATENTS

| | | | |
|---|---|---|---|
| 3,608,301 | 9/1971 | Loewengart | 58/23 A |
| 3,712,046 | 1/1973 | Dill | 58/23 R X |
| 3,757,509 | 9/1973 | Fujita | 58/23 R |
| 3,795,099 | 3/1974 | Tsuruishi | 58/23 R |
| 3,803,834 | 4/1974 | Reese | 58/152 R |
| 3,813,533 | 5/1974 | Cone et al. | 58/152 R X |
| 3,816,730 | 6/1974 | Yamamoto et al. | 58/152 R X |
| 3,852,952 | 12/1974 | Vittoz et al. | 58/23 R |
| 3,867,619 | 2/1975 | Arauchi | 58/152 R X |
| 3,950,935 | 4/1976 | Naito | 58/39.5 |
| 3,955,355 | 5/1976 | Luce | 58/50 R |

FOREIGN PATENTS OR APPLICATIONS

| | | |
|---|---|---|
| 1,349,044 | 3/1974 | United Kingdom |

*Primary Examiner*—Stanley J. Witkowski

[57] ABSTRACT

A watch/chronometer/wrist calculator/measurement device contains a crystal or analog precision source of pulse trains which is used to update a clock register serving as an information source and a multipurpose arithmetic accumulator. A manual keyboard provides means for entering decimal numbers into a third or input register to serve as an additional information source. Data entry means are provided for incrementing or decrementing the multipurpose accumulator by the number of units contained in the input register. An additional information source for the accumulator is the chronograph control. Entry means are provided to increment the number contained in the accumulator at a rate controlled by the chronograph control and by the precision source of pulse trains. A display select control provides means to manually switch the display mode between the clock register and the calculator/chronometer function. Additional automatic means is provided to switch the display function between the input register and the accumulator when in the calculator/chronometer mode.

The display device thus provides means for showing; optically, the decimal value of the digits in the clock register, or optionally, the number entered in the multipurpose accumulator. An update control provides means to reset, manually, the number contained in the clock register.

An alternate configuration of the device provides an electrical connection on the case to which an external voltage can be connected, means to make a measurement of such external voltage, and serves as an additional information source to enter the measurement into the multipurpose accumulator so as to display, digitally, the value of such measurement on the face of the device. Means is also provided to make a frequency or period measurement of the said external voltage provided said external voltage is periodic in nature.

7 Claims, 4 Drawing Figures

COMBINATION WRISTWATCH/CHRONOGRAPH/WRIST CALCULATOR/MEASURING DEVICE

BACKGROUND OF THE INVENTION

The present invention relates to the inclusion in a digital wristwatch, of a chronograph, a voltage, frequency and period measurement device, and a wrist calculator into one package. Current engineering art provides a digital wristwatch, using liquid crystal displays, quartz oscillator, and using complementary metal oxide field effect semiconductor logic techniques to divide the quartz oscillator frequency, typically 32,768 Hz, down to a frequency of 1 Hz to advance the clock register of the watch. Additional similar logic is used to count the frequency down, to store the current time, and provide the liquid crystal displays with the necessary waveforms. A battery provides the necessary power source for the circuitry. Obviously, since the size of the battery and all circuitry and displays must fit inside the watchcase, power consumption must be kept at a minimum, and all possible circuitry must be placed on a single large scale integration integrated circuit. It is characteristic that complementary metal oxide field effect semiconductor logic devices draw nearly negligible current in the quiescent state, and draw appreciable current only while switching. It follows that a frequency divider, such as used in currect art timekeeping circuitry, draws the larger amount of current in the higher frequency stages and almost negligible current in the low frequency stages. This phenomenon makes practical the inclusion of other desirable low frequency functions in a timekeeping device. It is known that economy may be achieved by multiplexing the functions performed by each circuit in the device, wherever possible.

It is known to selectively display some other function within a digital wristwatch. U.S. Pat. No. 3,757,509 issued Sept., 1973 to Fujita and U.S. Pat No. 3,795,099 issued March, 1974 to Tsuruishi both disclose a combination watch and chronograph with means to selectively display the contents of a memory register. U.S. Pat. No 3,803,834 issued April, 1974 to Reese discloses a combination wristwatch and calculator with means to couple either circuit to the display. Other combination devices are known in the art as well as digital display electronic timepieces with multiplexing features using integrated circuits as exemplified in U.S. Pat. No. 3,721,084 issued March, 1973 to Dargent. However these have been directed to displaying only alternate functions and the internal circuitry has been especially adapted to those functions rather than adapted to a multipurpose display capability.

There is need for a device to supplement the features of an electronic digital solid state watch with a plurality of additional functions. One such function may be a digital timer with selectable increments, such as hours, minutes, seconds, or tenths of seconds for measuring, for example, the speed of an automobile or a boat over a measured mile, for keeping track of the time on a parking meter, or for timing an industrial process or an athletic event.

A wrist calculator function may be provided which can perform various arithmetic functions such as recording expenditures in a supermarket, balancing a checkbook stub, or checking inventories.

A voltage, frequency, and period measuring device may be included, which can make voltage and frequency measurements on an externally applied signal and display the results of such measurement on the display on the face of the device. The device is thus capable of measuring pulse rates, temperatures (with the addition of simple external thermo-sensitive elements), or frequencies (such as tones produced by a musical instrument).

Accordingly one object of the invention is to provide an unique device which, in one form, can combine the function of a wristwatch, chronograph, wrist calculator and digital frequency, period and voltage meter.

Another object of the invention is to provide an electronic wristwatch which allows selective display of one of a plurality of information sources in compact form while enhancing the versatility of the various functions.

SUMMARY OF THE INVENTION

Briefly stated, the invention comprises, in a wristwatch, the combination of a precision pulse source supplying a clock register, a multipurpose accumulator, means to select and display the contents of either the clock register or the accumulator, and means for selectively entering one from a plurality of additional input information sources into said multipurpose accumulator.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawing, in which:

FIG. 1 is a simplified block diagram illustrating the principle of the invention, FIG. 2 is a view of a watch, FIG. 3 is an expanded block diagram illustrating one embodiment of the invention, and FIG. 4 is a block diagram illustrating another, more complex embodiment.

DESCRIPTION OF THE PREFERRED EMBODIMENT

Figure 1:
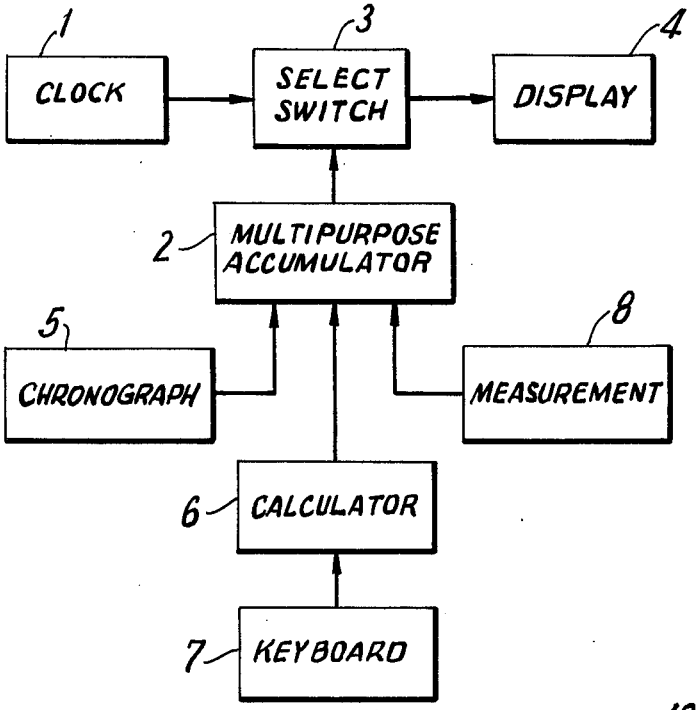

Referring now to FIG. 1 of the drawing, the block diagram shows the invention in greatly simplified form, eliminating some of the necessary details in order to explain the concept. A digital clock 1 and a multipurpose accumulator 2 provide outputs, either of which may be selected by a select switch 3 and shown, preferably in digital form by a display 4. A plurality of inputs from additional information sources which give information other than the time of day are selectively fed to accumulator 2, for example from a chronograph 5, a calculator 6 with keyboard 7, or from a measurement device 8. In the case of the chronograph, elapsed time pulses may be provided from the same pulse source as the clock 1.

The single display 4 is used to show either time, or the data from the accumulator 2, such as the entry just made into the keyboard 7, the current arithmetic answer from calculator 6, the value of the electrical measurement, from device 8, and in chronographic mode, the elapsed time from chronograph 5. As will be explained more fully later on, memory is provided so that the time of the day is preserved while chronographic, measurement, or arithmetic functions are being performed. Similarly, the chronometric elapsed time, or the last calculator result obtained will be preserved while the wearer checks the time and then returns to his calculation.

A precision source of pulse trains from clock 1 may be used to drive and advance the clock register (which serves as the time of day information source) while it also provides timing pulses for arithmetic functions, chronometric functions, and various data transfers within the device. Alternate embodiments of the device use a crystal oscillator or an analog (RC or LC) oscillator to control the precision pulse source.

The multipurpose accumulator 2 preferably operates as a simple up/down counter which is incremented or decremented by the same amount as the number in the input register of calculator 6 (an additional information source) so as to add or subtract the input number from the number in the arithmetic accumulator. Alternately, in the chronographic mode, the accumulator is incremented at such a rate as is selected by the control of chronograph 5 serving as an additional information source.

In the measurement mode, the multipurpose accumulator may be enabled from an additional information source during a time base provided by the clock 1 to count either the frequency on the external electrical input, or the frequency of a voltage controlled oscillator which is excited by the signal on the electrical input to generate a frequency proportional to the voltage of the electrical input. Alternately, period is measured by counting, in the accumulator the number of pulses from the precision pulse train generator between cycles of the waveform of the electrical input.

The display select switch 3 may be used to select the clock output or the accumulator output the latter depending on whether an input operation or an arithmetic operation has just been performed.

Economy may be accomplished by using only one BCD to seven segment decoder for the display 4. The clock output or the accumulator output are scanned, one digit at a time, and displayed.

In view of the static characteristics of the preferred complementary metal oxide field effect semiconductor logic devices, the additional power drains of the additional functions can be considered negligible.

Figure 2:
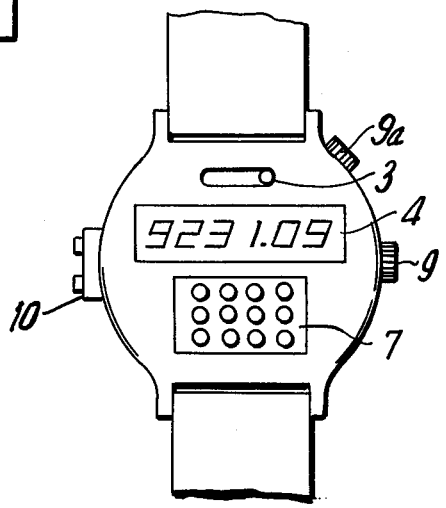

Referring to FIG. 2 of the drawing, a watch includes the display 4, the keyboard 7, the select switch 3, a conventional actuator 9 for updating, a chronometer actuator 9*a*, and a measurement input terminal 10.

Figure 3:
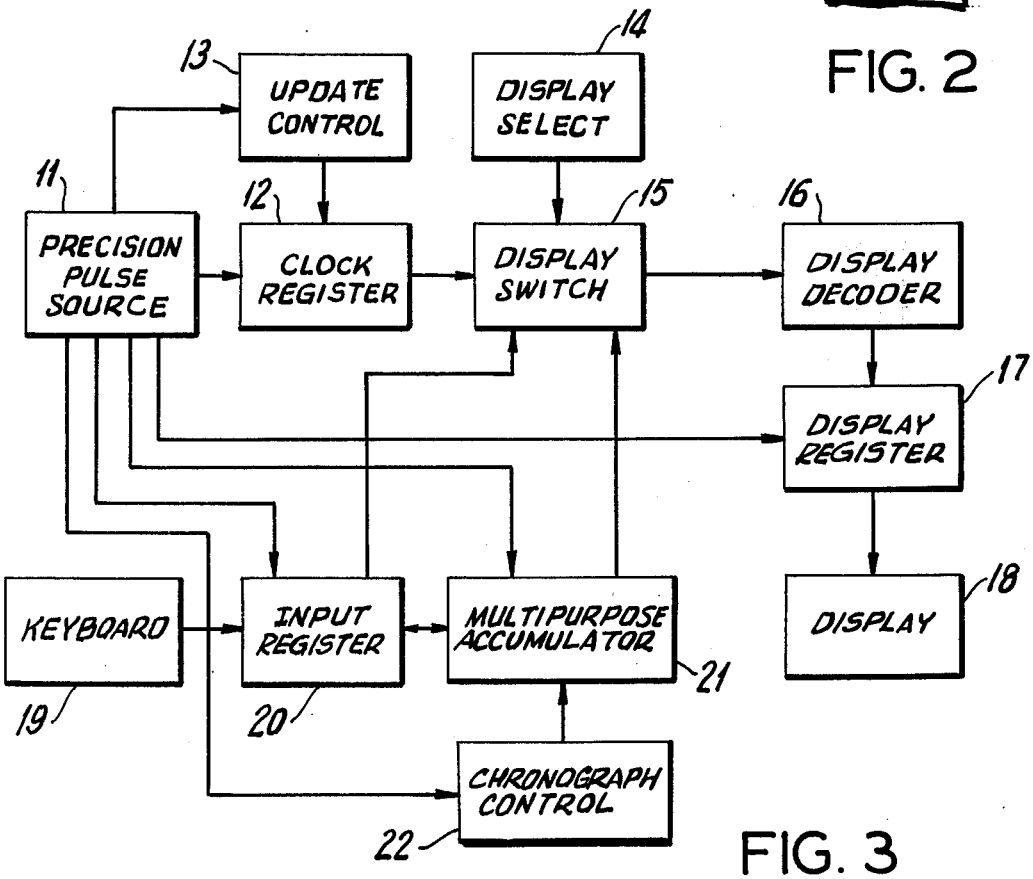

FIG. 3 discloses a block diagram arrangement of a preferred embodiment of the invention. Reference numbers do not always correspond to those used in connection with the very simplified block diagram of FIG. 1. The device includes a known type of precision pulse source 11, containing a quartz crystal oscillator at an appropriate high frequency, such as 32,768 Hz and frequency dividers providing various timing outputs comprising an information source for controlling data transfer within the device, including a 1 Hz output for advancing the clock register 12. A known type of manual update control 13 also receives appropriate timing pulse trains from the precision pulse source 11, and, as controlled by the wearer, resets the clock register 12 to serve as a source of time-of-day information by advancing, successively, the hours, minutes, and seconds portions of the clock register, 1 unit per second .

The clock register 12, preferably contains three twodigit pairs of counters to store and count, respectively, hours, minutes, and seconds. Each counter preferably contains four bistable multivibrators, and stores one decimal digit in binary coded decimal form. The seconds counter pair and the minutes counter pair each starts at "00" and provides a carry to the next higher digit and resets after "59". The hours counter pair starts at "1" and resets after "12". For example of a suitable conventional clock register, see page 309 of the *RCA SOLID STATE DATABOOK SERIES* (1973 edition). The output levels from the clock register feed the display switch 15, which may be a FET logic circuit actuated by a manual external "display select" actuator 14.

According to the present invention, a multipurpose arithmetic accumulator 21, accumulates the results of digital data supplied to it from a plurality of additional information sources. A six decimal digit up/down counter in the accumulator stores each of six decimal digits in four bistable multivibrators in binary coded decimal form, and the output of the 24 multivibrators feed the display switch 15. A suitable accumulator consists of six RCA COS/MOS counters Type CD 4029A connected for parallel clocking as shown on page 146 of 1973 edition of the aforesaid *RCA SOLID STATE DATABOOK SERIES.*

In the calculator mode, accumulator 21 operates in conjunction with the input register 20. The input register serves as an additional source of information to the accumulator. It is preferably a six decimal digit "down" counter similar to the accumulator and is used to temporarily store the keyboard input data. Again, this register can employ six CD 4029A counters arranged as above, except that they are connected as a down counter. Means are provided to pulse the inputs of the input register and the accumulator simultaneously until a "borrow" pulse appears on the borrow output of the input register. Means are also provided to cause the accumulator to count up when performing an addition computation or to count down when performing a subtraction operation so as to add or subtract the number contained in the input register to or from the number contained in the accumulator as appropriate. The foregoing devices are well known in the calculator art.

The 24 bistable multivibrator outputs from the input register feed to the display switch 15.

The keyboard 19 is located on the top of the watchcase, (see reference No. 3 in FIG. 2) and is adjacent to the six digit display. Preferably the keys are non-moving and are constructed to operate by impedance or capacitance changes when touched by a hand-held stylus. There are 10 digit keys, for entering the digits 0 through 9 into the input register. Means is provided to encode the digits into a binary coded decimal form and enter the digit selected on the keyboard 19, into the input register 20. For example, the J inputs to the counters are used to enter the BCD information for the digit key selected on the keyboard into the input register. Clear input and clear accumulator keys are also provided on the keyboard and appropriate means are provided to set all zeros into the input register 20, when a keyboard reset key is activated and into the arithmetic accumulator 21, when an accumulator reset key is activated. Arithmetic function keys, "+" and "−" are provided and means is provided to count the input register to "000000" while the accumulator 21 is incremented or decremented as appropriate when the + or − key is activated.

The chronograph control 22, which is an additional source of information giving elapsed time, enables the wearer to select manually whether 1/100 second, 1/10 second, 1 second, 1 minute or 1 hour pulses are fed to the count input of the multipurpose accumulator 21, when in chronograph mode. Means are provided to connect 100 Hz, 10 Hz, 1 Hz, 1/60 Hz, or 1/3600 Hz pulses from the precision pulse source 11, to the multipurpose accumulator 21, as appropriate. Means are also provided for the wearer to start and stop the multipurpose accumulator manually.

The display select control 14, (see reference No. 3 in FIGS. 1 and 2) allows the wearer to select manually between the watch mode, the calculator mode and the chronographic mode. Logic means are provided to cause the display switch 15, to connect to the display decoder 16, either the outputs from the clock register 12, in watch mode, or the outputs from the multipurpose accumulator or the input register. Additional means are provided to switch the display decoder to display the contents of the input register 20 after a keyboard numeric key has been activated, or the contents of the accumulator 21 after an arithmetic operation key has been activated. During chronograph mode, only the accumulator 21 is connected to the display decoder.

The display decoder 16, receives all six outputs from the selected register or accumulator. A scanning decoder in the display decoder continuously cycles through each 4-bit decimal digit of the selected register or accumulator and converts the binary decimal code into a seven segment display code. The seven segment output of the display decoder is similarly cycled to the appropriate seven segments of the appropriate digit in the display register 17.

The display register 17, contains 42 bistable multivibrators which act as memory devices to store the desired six decimal digits to be displayed. Each digit is loaded in succession as the display decoder 16, cycles. Thus each decimal digit in the display register is continuously updated with the appropriate number. Each bistable multivibrator output is modulated by the liquid crystal driving frequency, derived from the precision pulse source 11, and the modulated signal is fed to the display 18. Appropriate colon, sign, and decimal points are also stored in the display register in similar bistable multivibrators and are similarly modulated to drive the colon, sign and decimal point segments on the display.

DESCRIPTION OF MODIFIED FORM OF THE INVENTION

Figure 4:
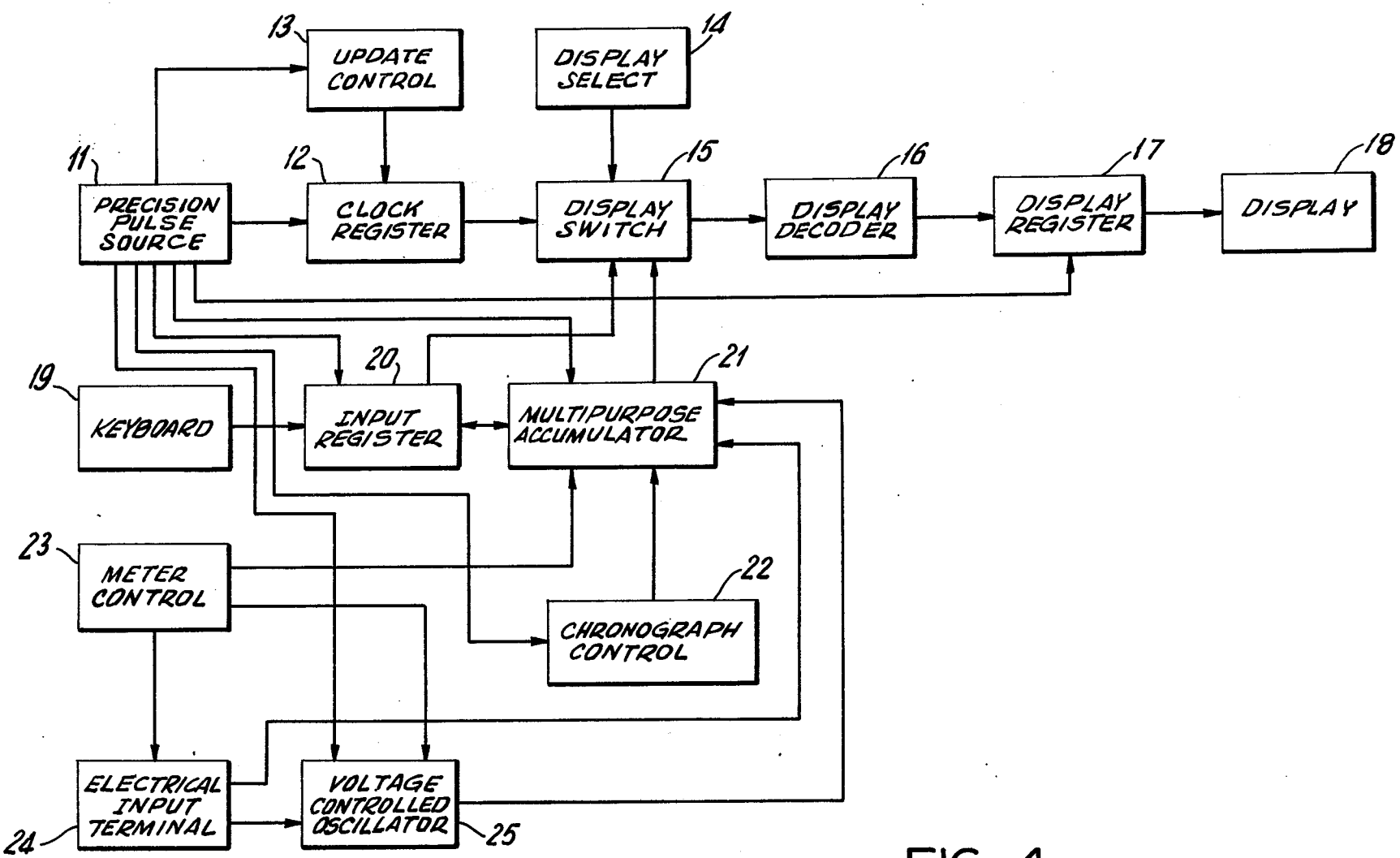

FIG. 4 discloses a block diagram arrangement of an alternate embodiment of the invention wherein means for measurement of an external electrical input provides an additional information source for the device shown in FIG. 3. Operation in the timekeeping, chronographic and calculator modes are similar to operation described in FIG. 3.

An external electrical input terminal, 24, is provided to connect an external electrical signal to the device. A meter control 23, which may consist merely of separate input terminals (see reference 10 in FIG. 2), enable the wearer to select, manually, a voltage measurement mode, a frequency measurement mode, or a period measurement mode.

In the voltage measurement mode, the electrical signal delivered to the electrical input terminal, 24, is connected to a known type of voltage-controlled oscillator 25. The voltage controlled oscillator generates a frequency very linearly proportional to the voltage provided it, and inversely proportional to a time base provided to it from the precision pulse source 11. The periodic signal generated by the voltage controlled oscillator 25 is connected to the input of the multipurpose accumulator 21 for the duration of the time base generated by the precision pulse source 11. At the end of the time base, the contents of the accumulator 21 are fed through the display switch 15, the display decoder 16, the display register 17, and to the display 18 similarly to the manner in which the chronometric measurement is displayed as above.

In the frequency measurement mode, operation is similar to that of the voltage measurement mode, except that the signal on the electrical input terminal is fed directly to the multipurpose accumulator, for the duration of the appropriate time base.

In the period measurement mode, operation is also similar except that the waveform of the electrical input provides the time base for the accumulator, which counts pulses from the precision pulse source.

Thus there has been described an improved electronic wristwatch with means to perform and display a plurality of other selected functions in very compact form. While there has been described what is considered to be the preferred forms of the invention, it is desired to secure in the appended claims all modifications which fall within the true spirit and scope of the invention.

I claim:

1. In a wristwatch of the type having a high frequency source, a countdown dividing circuit connected thereto to provide a source of pulses including timing pulses, display decoder means adapted for receiving binary coded decimal data and converting it to display code, and display means connected to said display decoder, the improvement comprising:

a clock register connected to receive said timing pulses and comprising an information source, a multipurpose accumulator comprising a counter connected to receive entry data from a selected one of a plurality of additional information sources other than the time of day, wherein one of said additional information sources selectively supplied to said accumulator comprises a keyboard, an input register connected to said keyboard, means to increment or decrement a number stored in said multipurpose accumulator by the value of the number contained in said input register, and means to selectively connect the number in said input register to said display decoder, means for controlling the admission of said entry data to said accumulator in one of a plurality of different ways according to the additional information source selected, and means for selecting the output from either said clock register or from said multipurpose accumulator and supplying binary coded decimal data to said display decoder.

2. In a wristwatch of the type having a high frequency source, a countdown dividing circuit connected thereto to provide a source of pulses including timing pulses, display decoder means adapted for receiving binary coded decimal data and converting it to display code, and display means connected to said display decoder, the improvement comprising:

a clock register connected to receive said timing pulses and comprising an information source, a multipurpose accumulator comprising a counter connected to receive entry data from a selected one of a plurality of additional information sources other than the time of day, wherein one of said additional information sources connected to supply the multipurpose accumulator comprises a chronograph control with means to increment the number stored in said multipurpose accumulator at a rate controlled by pulses from the countdown dividing circuit, and manual actuating means connected to said chronograph control for selecting an interval of time during which pulses are supplied, means for controlling the admission of said entry data to said accumulator in one of a plurality of different ways according to the additional information source selected, and means for selecting the output from either said clock register or from said multipurpose accumulator and supplying binary coded decimal data to said display decoder.

3. In a wristwatch of the type having a high frequency source, a countdown dividing circuit connected thereto to provide a source of pulses including timing pulses, display decoder means adapted for receiving binary coded decimal data and converting it to display code, and display means connected to said display decoder, the improvement comprising:

a clock register connected to receive said timing pulses and comprising an information source, a multipurpose accumulator comprising a counter connected to receive entry data from a selected one of a plurality of additional information sources other than the time of day, wherein one of said additional information sources connected to supply said multipurpose accumulator comprises an electrical input terminal, a manual meter control, and means to connect said electrical input terminal to said multipurpose accumulator as manually controlled by said meter control, to measure an externally applied electrical wave form connected to the input terminal.

means for controlling the admission of said entry data to said accumulator in one of a plurality of different ways according to the additional information source selected, and means for selecting the output from either said clock register or from said multipurpose accumulator and supplying binary coded decimal data to said display decoder.

4. The combination according to claim 3, including a voltage-controlled oscillator for generating a periodic voltage proportional to said externally applied waveform, and means to connect said periodic voltage to the input of said multipurpose accumulator.

5. In a wristwatch of the type having a high frequency source, a countdown dividing circuit connected thereto to provide a source of pulses including timing pulses, display decoder means adapted for receiving binary coded decimal data and converting it to display code, and display means connected to said display decoder, the improvement comprising:

a clock register connected to receive said timing pulses and comprising an information source, a multipurpose accumulator comprising a counter connected to receive entry data from a selected one of a plurality of addition information sources other than the time of day, wherein said plurality of additional information sources comprise a keyboard with input register, and a chronograph control, said input register and said chronograph control both supplied with pulses from said countdown dividing circuit, and means for selectively applying the contents either of said input register or of said chronograph control to said accumulator, means for controlling the admission of said entry data to said accumulator in one of a plurality of different ways according to the additional information source selected, and means for selecting the output from either said clock register or from said multipurpose accumulator and supplying binary coded decimal data to said display decoder.

6. The combination according to claim 5, including another additional information source comprising an electrical input terminal, a meter control, and means for selectively connecting said input terminal to said accumulator.

7. In a wristwatch of the type having a high frequency source, a countdown dividing circuit connected thereto to provide a source of pulses including timing pulses, display decoder means adapted for receiving binary coded decimal data and converting it to display code, and display means connected to said display decoder, the improvement comprising:

a clock register connected to receive said timing pulses and comprising an information source, a multipurpose accumulator comprising a counter connected to receive entry data from a selected one of a plurality of additional information sources other than the time of day, wherein said plurality of additional information sources comprise a keyboard with input register, a chronograph control, and a meter control with electrical input terminal connected to a voltage-controlled oscillator, means supplying pulses from the countdown dividing circuit to said input register, to said chronograph control and to said voltage-controlled oscillator, and means for selectively incrementing or decrementing the accumulator from a selected one of said plurality of additional information sources, means for controlling the admission of said entry data to said accumulator in one of a plurality of different ways according to the additional information source selected, and means for selecting the output from either said clock register or from said multipurpose accumulator and supplying binary coded decimal data to said display decoder.

* * * * *